US008096441B2

(12) United States Patent
Sato et al.

(10) Patent No.: US 8,096,441 B2
(45) Date of Patent: Jan. 17, 2012

(54) SEALING STRUCTURE FOR HIGH-PRESSURE CONTAINER

(75) Inventors: Syoji Sato, Sakura (JP); Kazuhiro Nakamura, Sakura (JP); Kenji Akita, Sakura (JP)

(73) Assignee: Yachiyo Industry Co., Ltd., Sayama-shi, Saitama-ken (JP)

( * ) Notice: Subject to any disclaimer, the term of this patent is extended or adjusted under 35 U.S.C. 154(b) by 541 days.

(21) Appl. No.: 12/230,687

(22) Filed: Sep. 3, 2008

(65) Prior Publication Data

US 2009/0071930 A1 Mar. 19, 2009

(30) Foreign Application Priority Data

Sep. 4, 2007 (JP) ..... 2007-228439

(51) Int. Cl.
*F17C 13/16* (2006.01)
*F17C 1/02* (2006.01)

(52) U.S. Cl. ..... 220/582; 220/586

(58) Field of Classification Search ..... 220/582, 220/586, 588, 589, 581, 592, 565, 562; 215/30, 215/40, 42, 50, 380; 280/830, 832, 834
See application file for complete search history.

(56) References Cited

U.S. PATENT DOCUMENTS

| | | | | |
|---|---|---|---|---|
| 6,227,402 | B1 * | 5/2001 | Shimojima et al. | 220/581 |
| 6,230,922 | B1 * | 5/2001 | Rasche et al. | 220/586 |
| 2009/0071930 | A1 * | 3/2009 | Sato et al. | 215/380 |

FOREIGN PATENT DOCUMENTS

| | | |
|---|---|---|
| DE | 196 31 546 C1 | 11/1997 |
| DE | 197 51 411 C1 | 1/1999 |
| FR | 2 744 517 | 8/1997 |
| JP | 2001-524653 | 12/2001 |
| JP | 2002-537530 | 11/2002 |
| JP | P3523802 | 2/2004 |
| WO | WO 00/49330 | 8/2000 |

OTHER PUBLICATIONS

European Search Report, 44001P EP/PReb dated Dec. 19, 2008.

* cited by examiner

*Primary Examiner* — Jacob K Ackun
*Assistant Examiner* — Kareen Rush
(74) *Attorney, Agent, or Firm* — Squire, Sanders & Dempsey (US) LLP

(57) ABSTRACT

In a multilayer pressure container constructed by covering a thin wall container made of synthetic resin or the like with a resin-impregnated fiber-reinforced layer and subsequently curing the impregnating resin, the present invention provides a sealing structure for a high-pressure container which allows sealing measures to be phased in during assembly before curing. The sealing structure for a high-pressure container 1 includes a resin liner 2 adapted to contain gas or liquid; a fiber-reinforced plastic layer 3 adapted to reinforce an outside face of the resin liner 2; and a metal mouthpiece 4 used to pour and discharge the gas or liquid, protruding outside the fiber-reinforced plastic layer 3, wherein a filler neck 21 for the gas or liquid is formed on the resin liner 2, protruding outward from inside the high-pressure container, coupling structures 23 and 43 are formed on a protrusion of the filler neck 21 and the mouthpiece 4, and the mouthpiece 4 is coupled with the resin liner 2 by means of the coupling structures 23 and 43 so as to cover the filler neck 21.

4 Claims, 5 Drawing Sheets

SEALING STRUCTURE FOR HIGH-PRESSURE CONTAINER

BACKGROUND OF THE INVENTION

1. Field of the Invention

The present invention relates to a sealing structure for a high-pressure container.

2. Description of the Related Art

Compressed natural gas (CNG) is attracting attention as clean energy which helps reduce global warming and expected to find expanded use as gasoline-alternative fuel for automobiles and the like. However, since gases have lower density than liquids and solids, to carry a larger amount of fuel, the volume of gas has to be reduced by high pressure. Consequently, a high-pressure container is required in order to contain the high-pressure gas. Conventionally, high-pressure containers made of steel or aluminum alloy have generally been used as high-pressure CNG containers. High-pressure containers made of metal provide the advantages of having high strength and high reliability in leakage resistance, but have the problem of heavy weight, resulting in penalties in terms of fuel economy and driving performance when the containers are used in automobiles.

In view of the above problem, to reduce container weight, a multilayer pressure container has recently been proposed in Japanese Patent No. 3523802, the multilayer pressure container being constructed by covering a thin wall container (liner) made of metal or synthetic resin with a resin-impregnated fiber-reinforced layer and subsequently curing the impregnating resin.

Conventionally, as shown in FIG. 2 of Japanese Patent No. 3523802, construction of a high-pressure container involves forming a synthetic resin liner integrally with a mouthpiece, covering the synthetic resin liner with a prepreg sheet of fiber-reinforced plastics (FRP) layer, and subsequently curing the prepreg sheet. In this case, if a leak path is found after the curing, it is not possible to repair the leak path once the resin has cured. This may result in decreased manufacturing yields.

An object of the present invention is to provide a sealing structure for a high-pressure container which allows sealing measures to be phased in during assembly before curing.

SUMMARY OF THE INVENTION

To achieve the above object, the present invention provides a sealing structure for a high-pressure container, comprising: a resin liner adapted to contain gas or liquid; a fiber-reinforced plastic layer adapted to reinforce an outside face of the resin liner; and a metal mouthpiece used to pour and discharge the gas or the liquid, protruding outside the fiber-reinforced plastic layer, wherein a filler neck for the gas or the liquid is formed on the resin liner, protruding outward from inside the high-pressure container, coupling structures are formed on a protrusion of the filler neck and the mouthpiece, and the mouthpiece is coupled with the resin liner by means of the coupling structures so as to cover the filler neck.

By forming the coupling structure on the filler neck of the resin liner and thereby allowing the resin liner to be coupled with the mouthpiece, this configuration makes it possible to check a seal against a potential leak path—i.e., the seal between the metal member and plastic member—for functionality immediately before the fiber-reinforced plastic layer not yet to be cured is mounted on the outside face of the resin liner. If there is any problem with the sealing function, a sealing measure can be applied to a valve in the filler neck mounted between the liner and mouthpiece, by removing the mouthpiece before filament winding or hand lay-up of the fiber-reinforced plastic layer.

Furthermore, a coupler provided on the mouthpiece in such a way as to cover an outside face of the filler neck causes the liner to press a contact face with the mouthpiece when the liner expands, providing a self-sealing capability to eliminate any leak path between the liner and mouthpiece.

In addition, according to the present invention, a sealing member may be interposed between the mouthpiece and a protrusion of the resin liner.

With this configuration, a sealing member such as an O-ring or sealing compound can be installed or filled easily by removing the mouthpiece and liner, which are coupled by means of the coupling structures, unless the resin-impregnated reinforcement fibers have already been wound (filament winding) or laminated (hand lay-up).

In addition, the mouthpiece according to the present invention may comprise a coupler which, being coupled with the resin liner by means of the coupling structures, covers an outside face of the filler neck, and a disk-shaped contact flange which forms a base of the coupler and contacts the outside face of the resin liner; and an outside face of the contact flange may form a surface continuous with the outside face of the resin liner.

The mouthpiece needs to be fastened securely as a part of the pressure container. Also, it is necessary to reduce potential leak paths to a minimum. For that, a base of the filler neck is formed into a disk shape to increase the area of contact with the liner and fiber-reinforced plastic layer and the resin-impregnated reinforcement fibers are wound around surfaces of the mouthpiece and liner coupled with each other. If there is any level difference at a seam between outer surfaces of the liner and mouthpiece disk, the wound fibers will get creased, resulting in decreased strength.

By eliminating any level difference and forming continuous outer surfaces, this configuration prevents the wound fibers from being creased.

In addition, according to the present invention, a clearance which opens to the outside of the high-pressure container may be formed between the mouthpiece and a protrusion of the resin liner which are coupled; and a sealing member may be inserted in the clearance.

With this configuration, by taking advantage of a basic feature of the present invention, i.e., capability to check the seal before the resin hardens, the clearance which enables active visual checking is provided to allow a sealing member to be inserted in the clearance. The sealing member may be either a solid whose shape matches the clearance or a resin which cures and hardens subsequently.

In addition, according to the present invention, the resin liner can be blow-molded.

With this configuration, the use of blow molding increases the flexibility in selecting a liner shape, making it possible to contour the resin liner to space in which the pressure container is housed.

In addition, the fiber-reinforced plastic layer can be formed by a filament winding process.

Available methods for forming the fiber-reinforced plastic layer also include a hand lay-up process, but this configuration increases pressure resistance and enables weight reduction.

The present invention provides a sealing structure for a high-pressure container which allows sealing measures to be phased in before curing.

DESCRIPTION OF THE PREFERRED EMBODIMENTS

First Embodiment

An exemplary structure of a high-pressure container to which a first embodiment is applied will be described below, followed by a description of sealing structures for a high-pressure container according to the first embodiment.

Figure 1:
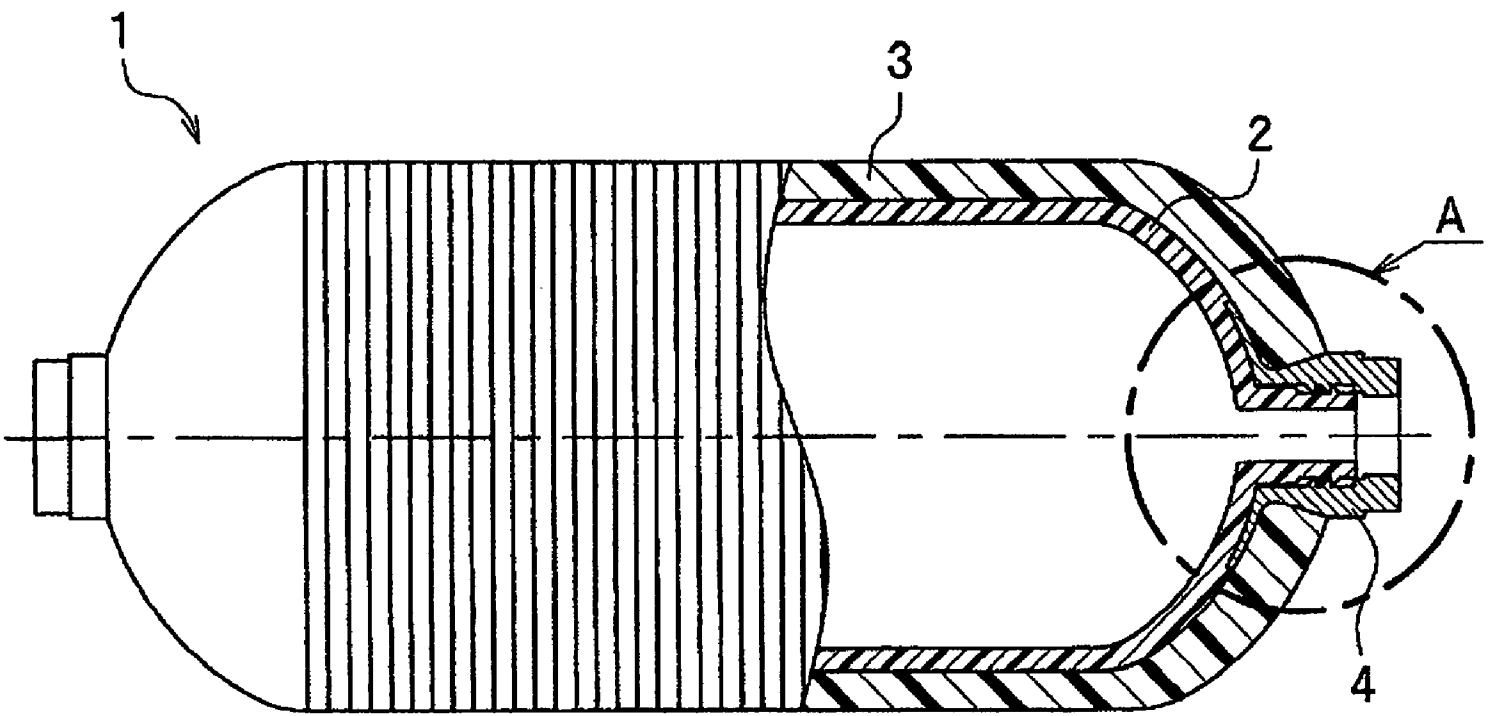
FIG. 1 is a side view of a high-pressure container according to the present invention.

FIG. 1 is a side view and partial sectional view of the high-pressure container. The high-pressure container 1 includes a resin liner 2 used to contain gas or liquid, a fiber-reinforced plastic layer 3 used to reinforce an outside face of the resin liner 2, and a mouthpiece 4 used to pour and discharge the gas or liquid, protruding outside the fiber-reinforced plastic layer 3.

The resin liner 2, which is used to contain gas or liquid, has its material selected according to a substance to be contained and filling conditions. Available materials include, for example, high density polyethylene (HDPE), polyamide, polyketone, and polyphenylene sulfide (PPS). The resin liner 2 is formed by rotational molding, blow molding, or the like.

The pressure container in its completed state is largely made up of the resin liner 2. Normally, a shape which allows further weight reduction in high-pressure environments is selected. For example, a cylindrical body with approximately hemispherical lids at both axial ends of the body such as shown in FIG. 1 or a spherical body is selected. However, when the pressure container is mounted as an automobile fuel tank in limited space, any of various forms including a flat shape may be required. In such a case, blow molding is suitable.

After the mouthpiece 4 is attached to the resin liner 2, resin-impregnated reinforcement fibers are wound around outer surfaces of the resin liner 2 and mouthpiece 4 by a filament winding process. Alternatively, the resin-impregnated reinforcement fibers are laminated by a hand lay-up process. Coupling structures of the resin liner 2 and mouthpiece 4 will be described later.

The fiber-reinforced plastic layer 3, which is made of so-called FRP (fiber-reinforced plastics), constitutes a major structural member in a pressure-resistant structure. Fibers (or cloth) impregnated with a resin are formed into a product shape, and then the resin is cured to form the fiber-reinforced plastic layer 3.

Epoxy resins are typically used for the fiber-reinforced plastic layer 3 because of high strength. However, phenolic resins can be used when thermal stability is required. Regarding the fibers, high-strength, high-elasticity fibers are often used and examples include carbon fibers, glass fibers, silica fibers, and Kevlar fibers. Such fibers, or cloth woven from the fibers, are(is) impregnated with the resin to form a so-called prepreg.

The methods for mounting the prepreg on the assembly of the resin liner 2 and mouthpiece 4 include the filament winding process which involves winding pre-impregnated fibers using a weaving machine and the hand lay-up process which involves stacking pre-impregnated woven cloth on the outer surfaces, as described above. The filament winding process is used commonly because of its capabilities to maintain continuity of the fibers, achieve high strength easily, and reduce wall thickness of the container.

The filament winding includes hoop winding which involves winding the fibers around the cylindrical part (circumferentially) in FIG. 1, in-line winding which involves winding the fibers axially, and helical winding which involves winding the fibers in a manner similar to the hoop winding, but at angles. An appropriate winding method, number of turns, winding angle, and the like are selected depending on stresses produced in the high-pressure container under pressure loading.

Once the prepreg is formed into a desired shape, if the fibers are impregnated with, for example, an epoxy resin, which is thermosetting, a semifinished product produced by mounting the prepreg on the assembly of the resin liner 2 and mouthpiece 4 is put in an autoclave set to a predetermined temperature, for a fixed period of time. Consequently, the resin cures, forming the fiber-reinforced plastic layer 3, and thus a product is finished.

The pressure container which uses a fiber-reinforced resin in this way cannot be repaired easily even if leakage of the contained gas or liquid is detected because the coupling structure is not removable once the resin hardens.

Figure 2:
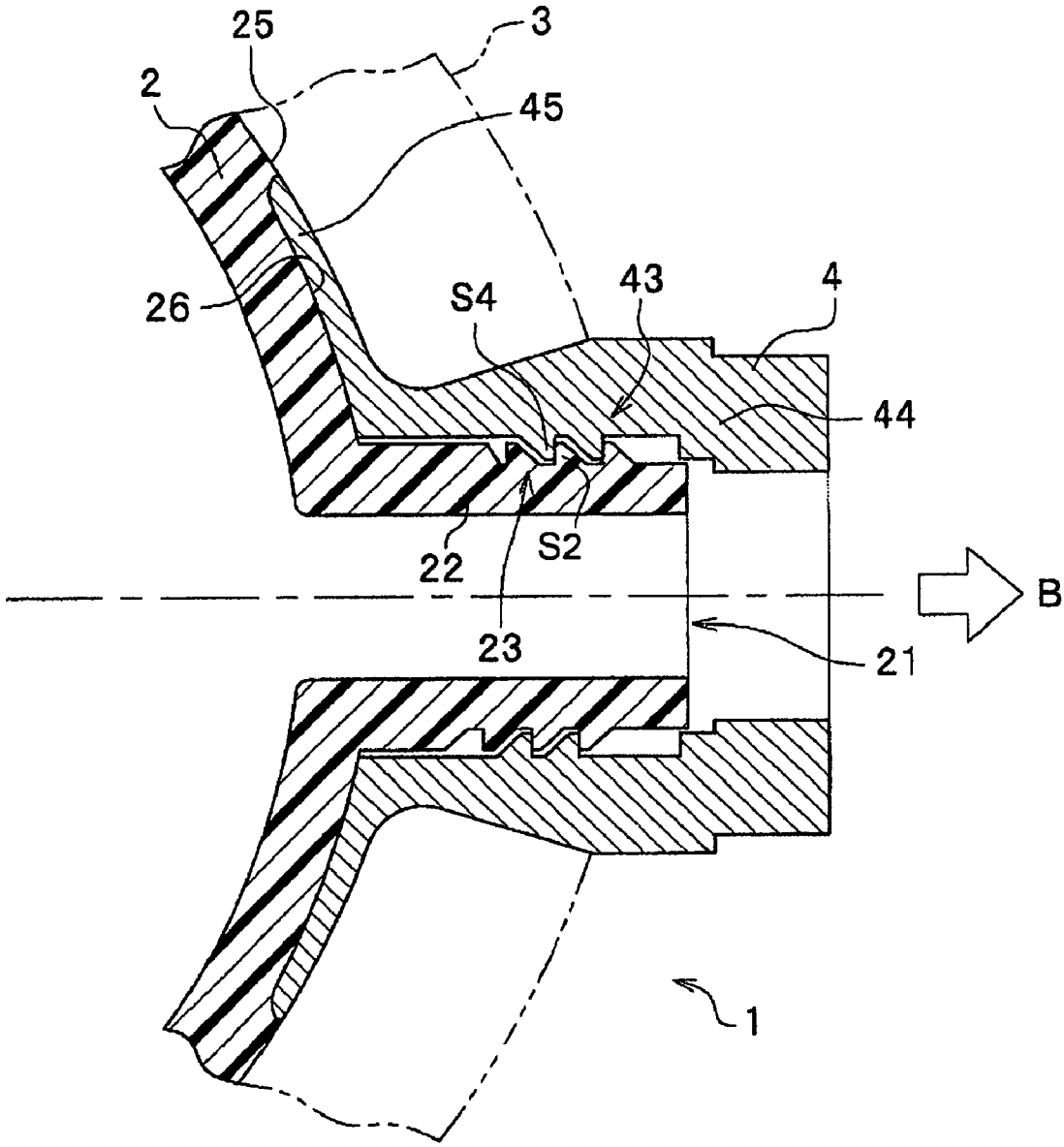
FIG. 2 is a detailed sectional view of part A in FIG. 1, showing coupling structures of a resin liner and mouthpiece according to a first embodiment of the present invention.

Next, the sealing structure for the high-pressure container according to the present embodiment will be described with reference to FIG. 2. FIG. 2 is a detailed view of part A in FIG. 1, showing the coupling structures of the resin liner 2 and mouthpiece 4.

A filler neck 21 for gas or liquid is formed on the resin liner 2, protruding outward (in direction B in FIG. 2) from inside the high-pressure container 1, coupling structures 23 and 43 are formed between a protrusion 22 of the filler neck 21 and the mouthpiece 4, and the mouthpiece 4 is coupled with the resin liner 2 by means of the coupling structures 23 and 43 so as to cover the filler neck 21.

According to the present embodiment, threads S2 cut as the coupling structure 23 in the filler neck 21 are screwed into threads S4 cut as the coupling structure 43 in the mouthpiece 4 to couple the resin liner 2 and mouthpiece 4. Various shapes are available for the threads S2 and S4. Tapered screw threads are suitable when it is desired to increase sealing ability in the direction of pressure loads and trapezoidal screw threads or ACME screw threads (square threads) with some looseness are suitable when it is desired to provide a clearance to be filled with a sealant or to provide a sufficient adjustment margin.

Incidentally, the coupling structures for the resin liner and mouthpiece are not limited to the threaded couplings described here, and needless to say lock couplings and the like may be used alternatively.

The coupler configured as described above makes it possible to check screwed condition of the coupling structures 23 and 43 as well as abutting condition of the resin liner 2 and mouthpiece 4 during trial fitting. Furthermore, it is possible to check for any leak path by conducting a leakage test with the two parts coupled and make repairs as required.

As shown in FIG. 2, the mouthpiece 4 includes a coupler 44 which, being equipped with the coupling structure 43, covers an outside face of the filler neck 21, and a disk-shaped contact flange 45 which forms a base of the coupler 44 and contacts an outside face 25 of the resin liner 2. The resin liner 2 has a recess 26 formed in that part of the outside face 25 which is abutted by the contact flange 45 and an outer surface of the contact flange 45 forms a surface continuous with the outside face 25 of the resin liner 2 except for the recess. A metal material such as an aluminum alloy or stainless steel alloy having high specific strength is used for the mouthpiece 4.

In this way, since there is no level difference at a seam between the outer surface of the liner 2 and disk-shaped outer surface of the mouthpiece 4, the fibers wound by the filament winding process will not get creased. This prevents breakage of fibers and thus local reduction of strength after curing of the resin.

A wide abutting surface between the contact flange 45 and recess 26 provides a self-sealing capability: when a high pressure is exerted on the product, the liner 2 on the inner side expands due to pressure difference between the abutting surface and a pressure chamber in the container, closing off any potential leak path between the abutting surface and pressure chamber.

Second Embodiment

Figure 3:
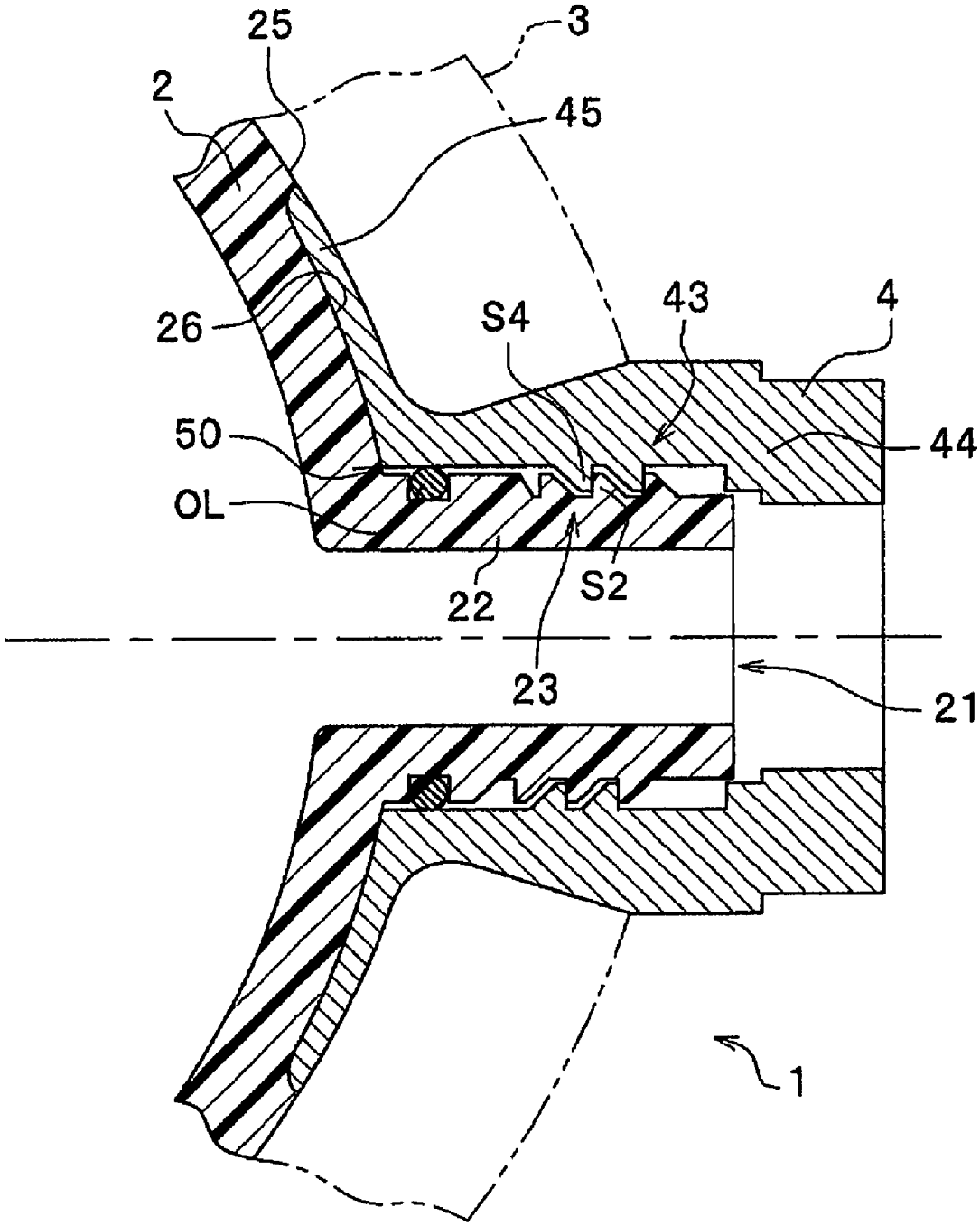
FIG. 3 is a detailed sectional view of part A in FIG. 1, showing coupling structures of a resin liner and mouthpiece according to a second embodiment of the present invention.

Next, a sealing structure for a high-pressure container according to a second embodiment will be described with reference to FIG. 3. FIG. 3 is a detailed view of part A in FIG. 1, showing coupling structures of the resin liner 2 and mouthpiece 4.

The present embodiment differs from the first embodiment in that an O-ring OL is installed near a corner 50 as a sealing member for an abutting portion between the resin liner 2 and mouthpiece 4, where the abutting portion could become a potential leak path. In this area, a potential leak path is closed off by self-sealing under pressure loading as described in the first embodiment, and the use of the O-ring OL increases the sealing effect by covering a root of the neck uniformly by elastic deformation.

Furthermore, even if a root of the protrusion 22 on the resin liner 2 is deformed by internal pressure exerted on the high-pressure container 1 filled with gas or liquid, the O-ring OL absorbs the deformation, provided that the deformation is within elastic limits of the O-ring. This prevents a leak path from being created between the resin liner 2 and mouthpiece 4 as well as prevents one of the resin liner 2 and mouthpiece 4 from deforming the other due to direct transmission of loads between the resin liner 2 and mouthpiece 4 abutting each other.

Although the O-ring OL is used according to the present embodiment, a filler may be applied to the same part alternatively. Furthermore, multiple O-rings with cross-section diameters varied according to amounts of deformation under pressure loading may be installed or a so-called backup ring with a non-circular cross section may be installed together with an O-ring. Available fillers include sealing compounds and resins. The installation location of the O-ring OL according to the present embodiment is only exemplary and may be installed in front of and/or behind the threads S2 and S4.

The coupling structures 23 and 43 allow the sealed part to be processed by checking the condition of sealing, provided the resin-impregnated reinforcement fibers or woven cloth has not been wound (filament winding) or stacked (hand lay-up) yet.

Third Embodiment

Figure 4A:
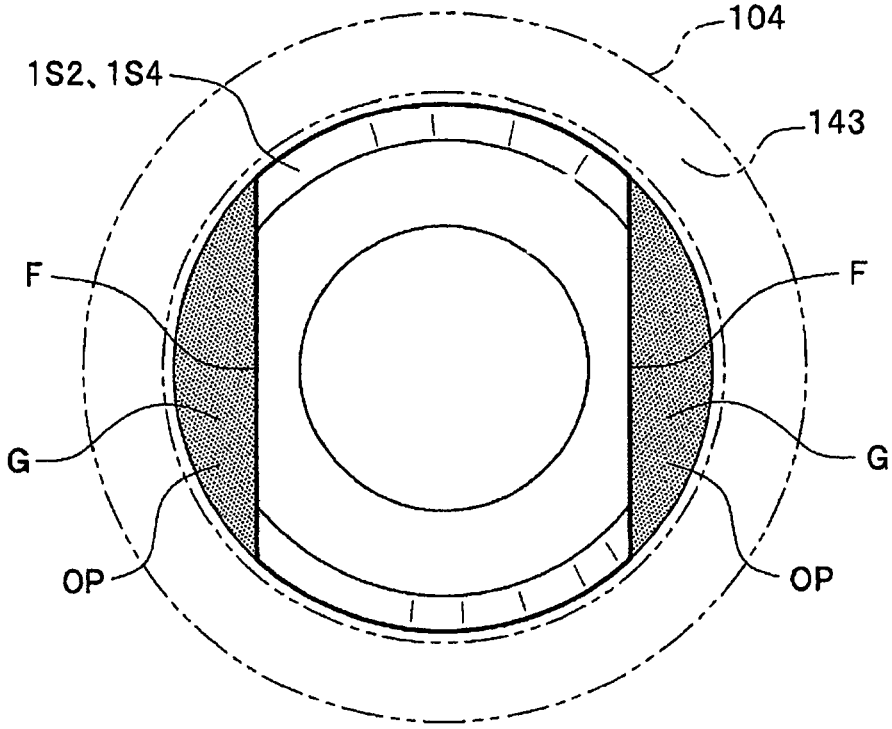
FIGS. 4A and 4B are enlarged views showing coupling structures of a resin liner and mouthpiece according to a third embodiment of the present invention.
Figure 4B:
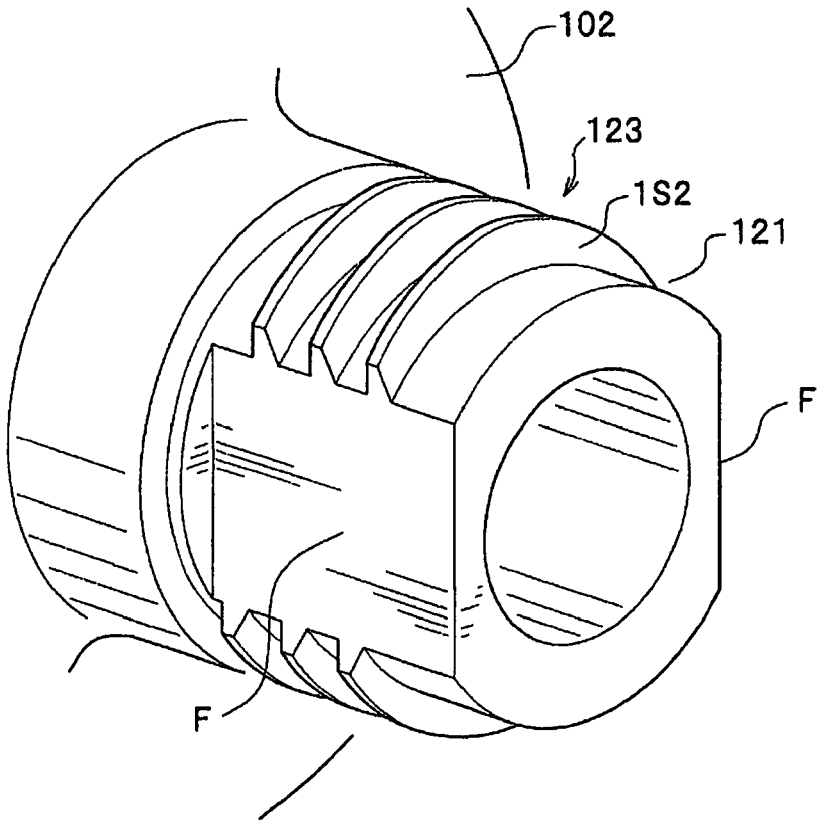

Next, a sealing structure for a high-pressure container according to a third embodiment will be described with reference to FIGS. 4A and 4B. FIG. 4A is an enlarged front view showing coupling structures of a resin liner 102 and mouthpiece 104 as viewed from the right in FIG. 2 while FIG. 4B is an enlarged exploded perspective view showing the coupling structure 123 of the resin liner 102 as viewed from a side.

The present embodiment differs from the first embodiment in that clearances G which open to the outside of the container are formed between the mouthpiece 104 and the coupling structure 123 of the resin liner 102 when the mouthpiece 104 and resin liner 102 are coupled and that a sealing member can be inserted in the clearances G.

Specifically, according to the present embodiment, as in the case of the first embodiment, threads 1S2 cut in the filler neck 121 are screwed into threads 1S4 cut in a coupling structure 143 of the mouthpiece 104 to couple the resin liner 102 and mouthpiece 104. As shown in FIG. 4B, the threads 1S2 have two chamfers F created in an axial direction of the threads 1S2 unlike the threads S2 according to the first embodiment (see FIG. 2). When the resin liner 102 and mouthpiece 104 are coupled, the chamfers F open to the outside of the container as shown in FIG. 4A, enabling visual checking and allowing the clearances G along the chamfers F to be filled with a resin or sealing member through the openings OP.

Incidentally, the clearances G along the chamfers F may be plugged with inserts (not shown) contoured to shape of the clearances G in advance and any remaining gap may be filled with a resin or sealing member.

Fourth Embodiment

Figure 5:
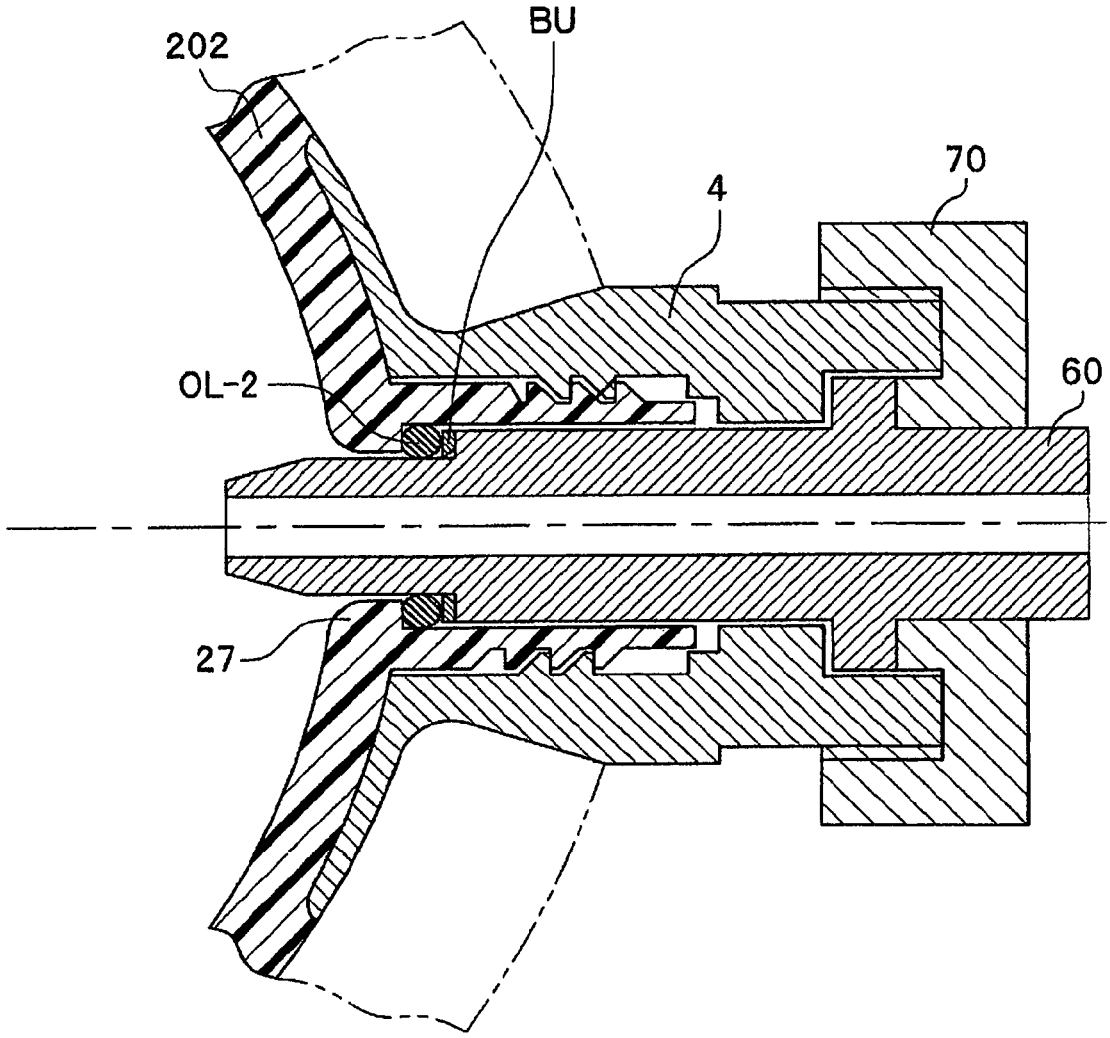
FIG. 5 is an enlarged sectional view showing how a valve and lock nut are coupled to coupling structures of a resin liner and mouthpiece according to a fourth embodiment of the present invention.

Next, a sealing structure for a high-pressure container according to a fourth embodiment will be described with reference to FIG. 5. FIG. 5 is an enlarged sectional view showing how a valve and lock nut are coupled to coupling structures of a resin liner and mouthpiece according to the present embodiment.

In the present embodiment, a valve 60 needed to actually mount the container on an automotive vehicle is attached to the mouthpiece 4 using a lock nut 70, but basic components of the present embodiment—resin liner 202, mouthpiece 4, and coupling structures 23 and 43—are the same as the first embodiment (see FIG. 2).

The valve 60 is inserted in the filler neck 21 (see FIG. 2) of the resin liner 202. To provide a seal between the valve 60 and filler neck 21, an O-ring OL-2 and backup ring BU are installed in a gap between a fall prevention wall 27 of the resin liner 202 and the valve 60. The backup ring BU is installed to prevent the O-ring OL-2 from being displaced and thereby provide a secure seal even if the resin liner 202 and mouthpiece 4 are deformed under pressure.

As in the case of the second embodiment, even if a root of the protrusion 22 (see FIG. 2) on the resin liner 202 is deformed by internal pressure exerted on the high-pressure container 1 filled with gas or liquid, the O-ring OL-2 absorbs the deformation, provided that the deformation is within elastic limits of the O-ring. This prevents a leak path from being created between the resin liner 202 and valve 60 as well as prevents one of the resin liner 202 and mouthpiece 4 from deforming the other due to direct transmission of loads between the resin liner 202 and valve 60 abutting each other.

Preferred embodiments of the present invention have been described above. However, the present invention is not limited to the embodiments described with reference to the drawings, and design changes may be made without departing from the spirit and scope of the present invention. In particular, the coupling structures for the resin liner and mouthpiece are not limited to the threaded couplings described above, and needless to say lock couplings and the like may be used alternatively.

We claim:

1. A sealing structure for a high-pressure container, comprising:

a resin liner adapted to contain gas or liquid;

a fiber-reinforced plastic layer adapted to reinforce an outside face of the resin liner;

a metal mouthpiece used to pour and discharge the gas or the liquid into and out of the resin liner, protruding outside the fiber-reinforced plastic layer;

a filler neck for the gas or the liquid formed on the resin liner, protruding outward from the resin liner and into the metal mouthpiece;

coupling structures formed on a protrusion of the filler neck and the mouthpiece for securing the mouthpiece on the filler neck;

a valve inserted and secured in the mouthpiece;

a fall prevention wall extending from the resin liner below said filler neck; and an O-ring seal interposed between the fall prevention wall and an opposing part of the valve.

2. The sealing structure for a high-pressure container according to claim 1, wherein the mouthpiece comprises a coupler which, being coupled with the resin liner by means of the coupling structures, cover an outside face of the filler neck, and a disk-shaped contact flange which forms a base of the coupler and contacts the outside face of the resin liner; and an outside face of the contact flange forms a surface continuous with the outside face of the resin liner.

3. The sealing structure for a high-pressure container according to claim 1, wherein the resin liner is blow-molded.

4. The sealing structure for a high-pressure container according to claim 1, wherein the fiber-reinforced plastic layer is formed by a filament winding process.

* * * * *